US009611708B2

(12) United States Patent
Rios, III

(10) Patent No.: US 9,611,708 B2
(45) Date of Patent: Apr. 4, 2017

(54) PACKER SETTING AND/OR UNSETTING

(71) Applicant: WEATHERFORD TECHNOLOGY HOLDINGS, LLC, Houston, TX (US)

(72) Inventor: Aristeo Rios, III, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 24 days.

(21) Appl. No.: 13/941,165

(22) Filed: Jul. 12, 2013

(65) Prior Publication Data

US 2014/0014353 A1 Jan. 16, 2014

Related U.S. Application Data

(60) Provisional application No. 61/671,599, filed on Jul. 13, 2012.

(51) Int. Cl.

| | |
|---|---|
| ***E21B 7/12*** | (2006.01) |
| ***E21B 23/06*** | (2006.01) |
| ***E21B 33/00*** | (2006.01) |
| ***E21B 33/08*** | (2006.01) |

(52) U.S. Cl.

CPC ..... *E21B 23/06* (2013.01); *E21B 33/00* (2013.01); *E21B 33/085* (2013.01)

(58) Field of Classification Search

CPC ..... E21B 33/129; E21B 33/1291; E21B 33/1292; E21B 33/1293; E21B 23/06

USPC ..... 166/351, 352, 355, 359, 360, 378, 119, 166/387; 277/323, 328

See application file for complete search history.

(56) References Cited

U.S. PATENT DOCUMENTS

| | | | | |
|---|---|---|---|---|
| 2,921,633 | A * | 1/1960 | Baker | E21B 33/1216 277/338 |
| 3,991,826 | A | 11/1976 | Baugh | |
| 4,842,082 | A | 6/1989 | Springer | |
| 8,322,432 | B2 | 12/2012 | Bailey et al. | |
| 2010/0175882 | A1 | 7/2010 | Bailey et al. | |
| 2010/0243235 | A1 | 9/2010 | Caldwell et al. | |
| 2012/0013133 | A1 | 1/2012 | Rios, III | |
| 2012/0318496 | A1 | 12/2012 | Bailey et al. | |

FOREIGN PATENT DOCUMENTS

| | | | |
|---|---|---|---|
| GB | 2429473 | A | 2/2007 |

OTHER PUBLICATIONS

Lindquist, Patrizia, PCT Invitation to Pay Additional Fees and, Where Applicable, Protest Fee, Jul. 21, 2014, 6 pages, European Patent Office, Rijswijk, Netherlands.

International Search Report issued Sep. 1, 2014 for PCT Patent Application No. PCT/US13/050371, 7 pages.

Written Opinion issued Sep. 1, 2014 for PCT Patent Application No. PCT/US13/050371, 9 pages.

* cited by examiner

*Primary Examiner* — Matthew R Buck
*Assistant Examiner* — Patrick Lambe
(74) *Attorney, Agent, or Firm* — Smith IP Services, P.C.

(57) ABSTRACT

Linear movement via a sliding mandrel configured to translate axially is converted into radial movement to compress a packer. The packer is configured to seal an item of oilfield equipment typically in a subsea environment. The packer may also be used to return or reverse the radial movement and/or the linear movement.

13 Claims, 8 Drawing Sheets

PACKER SETTING AND/OR UNSETTING

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM LISTING APPENDIX

Not applicable.

BACKGROUND

Technical Field

Oilfield operations may be performed in order to extract fluids from the earth (including subsea). When a well site is completed, pressure control equipment may be placed near the surface of the earth. The pressure control equipment may control the pressure in the wellbore while drilling, completing and producing the wellbore. The pressure control equipment may include blowout preventers (BOP), rotating control devices (RCD), and the like.

The rotating control device or RCD is a drill-through device with a rotating seal that contacts and seals against the drill string (drill pipe, casing, drill collars, Kelly, etc.) for the purposes of controlling the pressure or fluid flow to the surface. For reference to an existing descriptions of a rotating control device incorporating a system for sealing a marine riser having a rotatable tubular, please see U.S. Pat. No. 8,322,432 entitled "Subsea Internal Riser Rotating Control Device System and Method", U.S. application Ser. No. 12/643,093, filed Dec. 21, 2009 and published Jul. 15, 2010; and US patent publication number US 2012/0318496 entitled "Subsea Internal Riser Rotating Control Head Seal Assembly", U.S. application Ser. No. 13/597,881, filed Aug. 29, 2012 and published Dec. 20, 2012 the disclosures of which are hereby incorporated by reference. These publications describe a rotating control device having a seal assembly to seal the RCD with the riser.

Conventional sealing systems for RCD's include a drill string sealing element which seals against the rotating drill string and several external seals which seal against a fixed flanged housing. The flanged housing is part of stackup below the rig. The RCD external housing is held fixed to the flanged housing by hydraulic or mechanical means. Downhole pressure is contained via the internal drill string sealing element and the external static seals on the housing.

Conventional packers have external sealing elements that are hydraulically set via downhole pressure. The packer sealing element is held in the set position via a body lock ring. Pressure below the packer is contained via the packer element sealing against the casing. To unset the packer the housing lock ring is released via a shear ring and a collet by pulling up or setting down load on the packer. Conventional packers can only be set and unset once and then they have to be pulled out of the hole for redress due to the shear ring use.

Since packer elements are elastomers and have limited use they have to be replaced periodically making it very costly or impossible to retrieve from, for example, a flanged housing, subsea riser, or casing. A need exists for a seal system that can be set and retrieved with the RCD instead of being part of the permanent or semi-permanent components (e.g. flanged housing, subsea riser or casing).

BRIEF SUMMARY OF THE EMBODIMENT(S)

This seal system uses a packer type sealing element in one embodiment on the external housing of a RCD however it is set and unset mechanically instead of hydraulically. The RCD can therefore be set anywhere there is a locking profile, e.g. flanged housing (in a stackup rig configuration), subsea riser or in casing.

In this embodiment the RCD housing has external biased out latch locking dogs that engage a profile in the flanged housing, riser or casing. Once the latch locking dogs engage the profile the RCD housing is locked in place from moving further downhole. The mandrel inside the RCD housing is locked to the drill string via mechanical means. As the drill string is lowered the mandrel pushes out a different set of dogs that push against the packer housing which sets the packer(s). Now the downhole pressure is held in place by the drill string sealing element and the external packer(s) on the RCD housing. To unset the packer(s) the translating mandrel is pulled up and the stored energy of the packer(s) will push the packer housing and therefore the dogs back in radially.

Advantages of this system are that the packer(s) can be set and unset multiple times as long as the packer(s) is not damaged; the packer(s) can be easily replaced and then reinstalled; and/or the packer(s) can be deployed in a subsea RCD.

Accordingly, linear movement via a sliding mandrel configured to translate axially is converted into radial movement to compress a packer. The packer is configured to seal an item of oilfield equipment typically in a subsea environment. The packer may also be used to return or reverse the radial movement and/or the linear movement.

As used herein the terms "radial" and "radially" include directions inward toward (or outward away from) the center axial direction of the drill string or item of oilfield equipment but not limited to directions perpendicular to such axial direction or running directly through the center. Rather such directions, although including perpendicular and toward (or away from) the center, also include those transverse and/or off center yet moving inward (or outward), across or against the surface of an outer sleeve of item of oilfield equipment to be engaged.

DETAILED DESCRIPTION OF THE EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
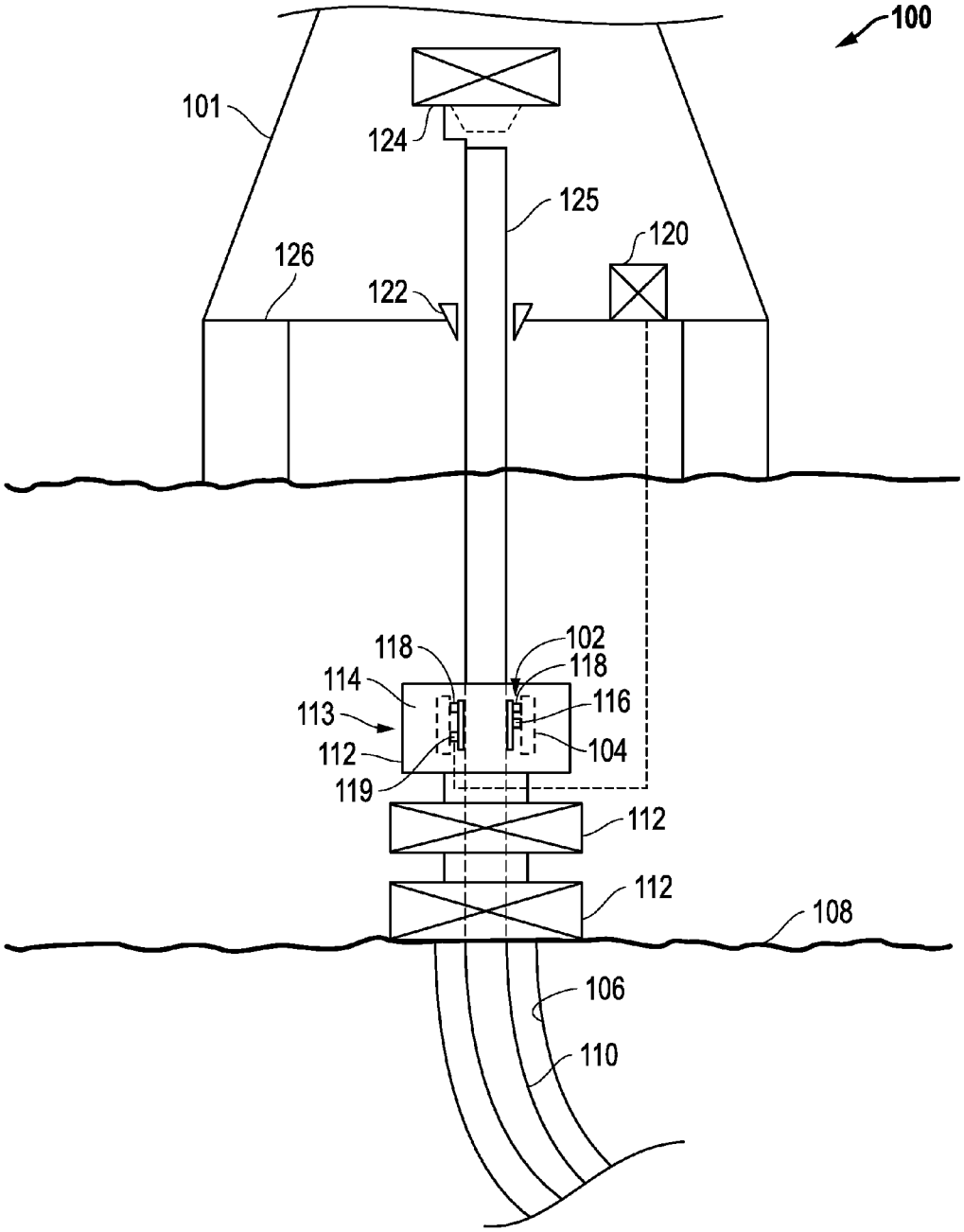
FIG. 1 depicts a schematic view of a wellsite.
Figure 6:
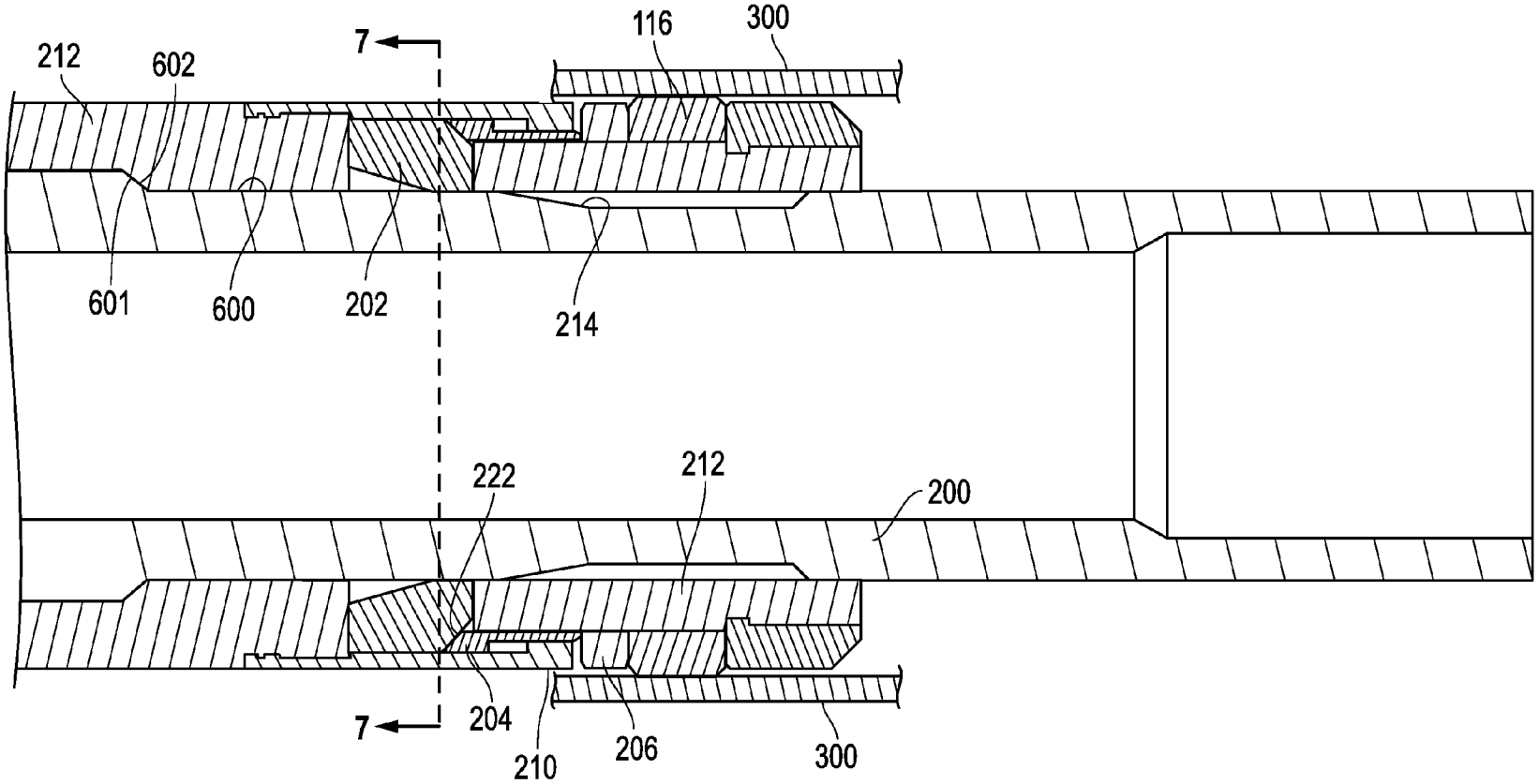
FIG. 6 depicts a longitudinal cross section of the seal system in an actuated or set position.

FIG. 1 depicts a schematic view of a wellsite 100 with a rig 101. The wellsite 100 has a seal system 102 for sealing to an item or piece of oilfield equipment 104. As shown, the wellsite 100 is an offshore wellsite although other types of wellsites are applicable. The wellsite 100 may have a wellbore 106 formed in the sea floor 108 and lined with a casing 110. At the sea floor 108 one or more pressure control devices 112 may control pressure in the wellbore 106. The pressure control devices 112 may include, but are not limited to, BOPs, RCDs 113, and the like. The seal system 102 is shown and described herein as being located in a housing 114. The seal system 102 may have one or more seal member(s)/packer(s) 116 configured to engage the oilfield equipment 104. The seal system 102 may have one or more actuators 118 configured to drive the seal member 116 into and out of engagement with the oilfield equipment 104. The seal system 102 may set and unset the seal member 116 via mechanical movement of a mandrel as will be discussed in more detail below. The oilfield equipment 104 may be any suitable equipment that will be sealed with the seal system 102 including, but not limited to, the RCD 113, a drill string, a casing, a production tubing, a sleeve, and the like. The seal system 102 may further include one or more sensors 119 configured to identify the status of the seal system 102 and/or to inform the controller 120 that the packer 116 is sealed, not sealed, and/or at an intermediate position. The seal system 102, for example, may be incorporated with a subsea RCD 113 and used for sealing against a riser 300 (FIG. 6).

The wellsite 100 may have a controller 120 for controlling the seal system 102. In addition to controlling the seal system 102, the controller 120, and/or additional controllers (not shown), may control and/or obtain information from any suitable system about the wellsite 100 including, but not limited to, the pressure control devices 112, the housing 114, the sensor(s) 119, a gripping apparatus 122, a rotational apparatus 124, and the like. As shown, the gripping apparatus 122 may be a pair of slips configured to grip a tubular 125 (such as a drill string, a production string, a casing and the like) at a rig floor 126; however, the gripping apparatus 122 may be any suitable gripping device. As shown, the rotational apparatus 124 is a top drive for supporting and rotating the tubular 125, although it may be any suitable rotational device including, but not limited to, a Kelly, a pipe spinner, and the like. The controller 120 may control any suitable equipment about the wellsite 100 including, but not limited to, a draw works, a traveling block, pumps, mud control devices, cementing tools, drilling tools, and the like.

Figure 2:
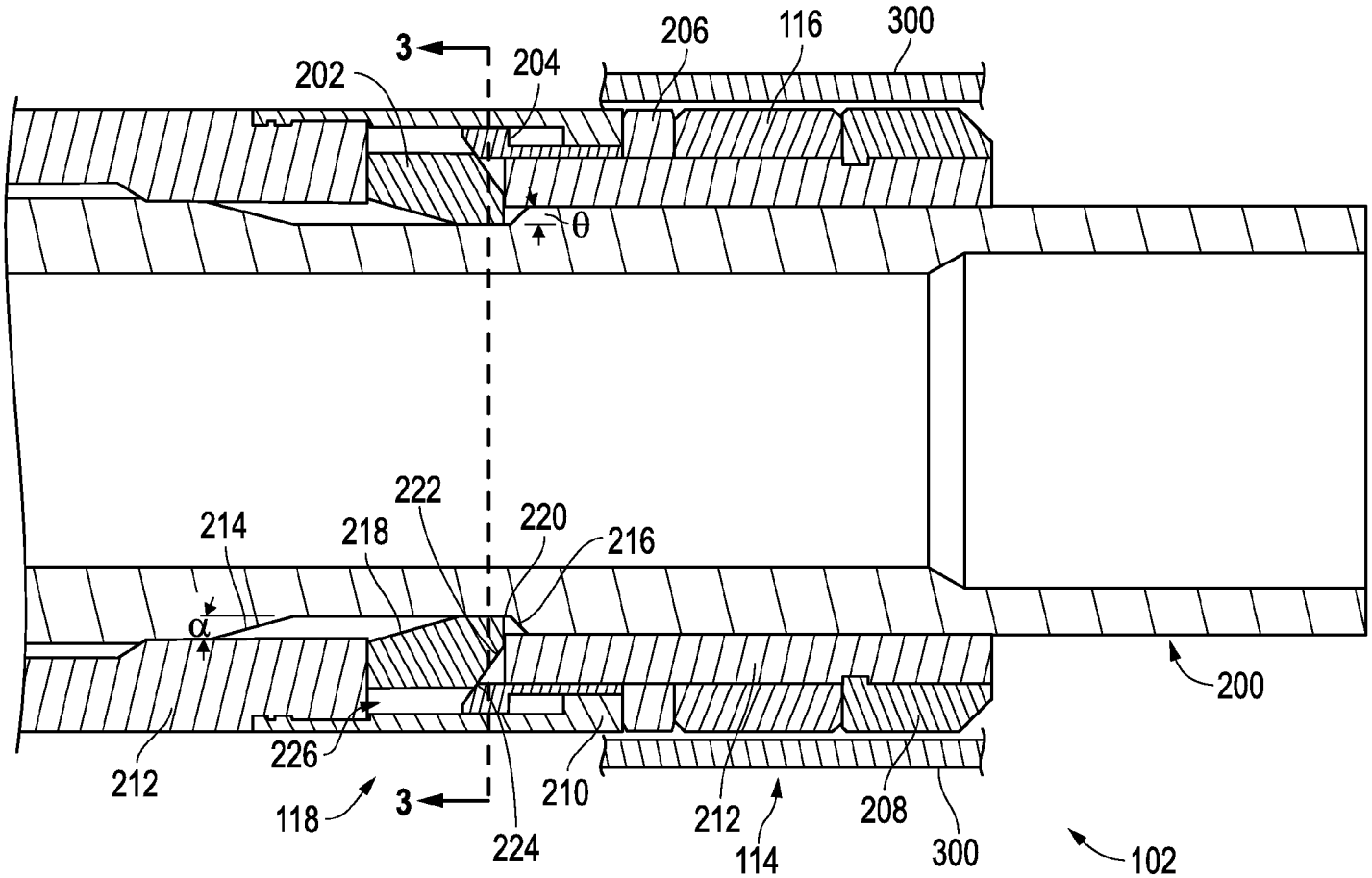
FIG. 2 depicts a longitudinal cross sectional view of the housing or a running in position having the seal system according to an embodiment.

FIG. 2 depicts a longitudinal cross sectional view of the housing 114 having the seal system 102 according to an embodiment. The housing 114, as shown, has the seal member or packer 116 (in the unset position, i.e. not opposing or sealing against the flanged housing, casing or subsea riser 300) and the one or more actuators 118. The actuator 118 (which may for example be mounted below the RCD 113 body) may include, but is not limited to, a sliding mandrel 200, a dog 202, a sliding sleeve 204, a packer ring 206, an engagement portion 208, an outer sleeve 210, and a stationary mandrel, tool body, or stationary housing 212. The actuator 118 may be configured to set and unset the sealing member or packer 116 via axial movement of the sliding mandrel 200. The axial translation of the sliding mandrel 200 may convert the axial movement into radial movement via the dog 202. The dog 202 may then convert the radial translation back into axial movement via the sliding sleeve 204. The sliding sleeve 204 may engage the packer ring 206 and thereby compress the packer 116 in order to set the packer 116 as will be discussed in more detail below.

The sealing member or packer 116 may be any suitable deformable packer sealing member including, but not limited to an elastomeric member, and the like, configured to expand radially outward upon axial compression of the sealing member 116.

The sliding mandrel 200 may have a setting surface 214 configured to engage the dog 202 in order to set and unset the packer 116. As shown, the setting surface 214 is located in a profile formed in an outer surface of the sliding mandrel 200. The setting surface 214 may be configured to engage a dog setting surface 218. As the setting surface 214 engages the dog setting surface 218, the continual axial movement in the setting direction of the sliding mandrel 200 forces the dog 202 to translate radially outward, or away from the sliding mandrel 200. When unsetting the packer 116, the sliding mandrel 200 may be moved in the opposite direction, or unsetting direction. Once the setting surface 214 disengages the dog setting surface 218, the stored energy in the packer 116 may force the packer ring 206 and thereby the sliding sleeve 204 to release and/or unset the packer 116.

The sliding mandrel 200 may move in the unset and setting direction via mechanical manipulation of the sliding mandrel 200 from the rig 101 or drill string. Further, the sliding mandrel 200 may move via hydraulic, electric, pneumatic power and the like.

The setting surface 214 may have a relatively small angle $\alpha$ configured to engage the dog setting surface 218 having a similar angle as $\alpha$. The small angle $\alpha$ allows relatively large translations of the sliding mandrel 200 to translate into small outward radial movement of the dog 202. This small radial movement of the dog 202 may gradually set the packer 116 by gradually moving the sliding sleeve 204.

Opposite the setting surface 214 may be a secondary setting surface 216. The secondary setting surface 216 may have a larger or steeper angle $\theta$ than the small angle $\alpha$. The larger angle $\theta$ of the secondary setting surface 216 may engage a dog secondary setting surface 220. The larger angle may move the dog 202 radially away from the sliding mandrel 200 at a faster rate per axial translation of the sliding mandrel 200 than the setting surface. Therefore, the operator may relatively more slowly engage and/or set the packer 116 by moving the sliding mandrel 200 in the setting direction (downhole) and then may relatively more quickly release the packer 116 by moving the sliding mandrel in the unsetting direction with the secondary setting surface 216 engage in the dog secondary setting surface 220.

In an alternative embodiment, the secondary setting surface 216 may be a shoulder configured to engage the dog 202 thereby stopping travel of the sliding mandrel 200.

In an alternative embodiment the secondary setting surface 216 can be angled in an opposite direction (not shown) arranged in order to pull the dog(s) 202 radially inward. In this embodiment, the dog(s) 202 could also positively pull the sliding sleeve 204 toward the disengagement position.

There may be one or multiple dogs 202 located around the sliding mandrel 200. As shown there are multiple dogs 202 which travel radially though one or more slots 226 in the stationary mandrel 212. Although not shown, the dog 202 may be biased radially inward, or toward the unset position.

The dog 202 may have a dog actuation surface 222 configured to a sleeve actuation surface 224 on the sliding sleeve 204. As the dog 202 travels radially away from the sliding mandrel 200 the dog actuation surface 222 engages the sleeve actuation surface 224. Continued radial movement of the dog 202 outward moves the sliding sleeve 204 toward the packer ring 206 due to the interaction between the dog actuation surface 222 and the sleeve actuation surface 224. Although not shown, the dog 202 may be biased radially inward, or toward the unset position.

In an alternative embodiment, the dog actuation surface 222 may be locked to the sleeve actuation surface 224 for example with a dove tail configuration in order to positively move the sliding sleeve 204 both toward and away from the packer ring 206.

The sliding sleeve 204 may travel through an aperture formed between the outer sleeve 210 and the stationary mandrel 212. A nose 228 of the sliding sleeve 204 engages the packer ring 206 as the dog(s) 202 actuate the sliding sleeve 204. The sliding sleeve 204 then moves the packer ring 206 toward the packer 116 thereby compressing the packer 116 into an actuated position. There may be one annular sliding sleeve 204 or multiple sliding sleeves 204 for each of the dogs 202.

The packer ring 206 may be a full ring around the proximate the packer 116, or may be a partial ring. Further, there may be a second packer ring 206*a* (see FIG. 4) located on the opposite side of the packer 116. The second packer ring 206*a* may distribute the compression force on the packer 116 from the sliding sleeve 204.

Figure 3:
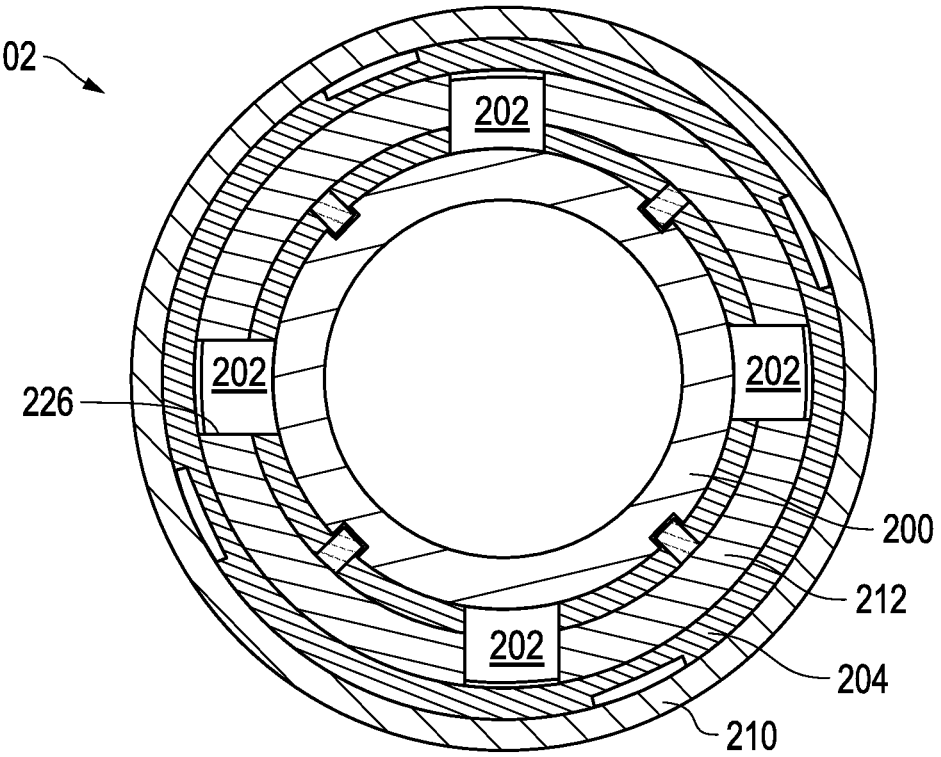
FIG. 3 depicts a top cross section view or running in position of the seal system taken through the dogs.

FIG. 3 depicts a top cross section view of the seal system 102 taken through the dogs 202. As shown, the seal system 102 is in the unactuated, or run in, position. In the run in position, the setting surface 214 and/or the secondary setting surface 216 (as shown in FIG. 2) have not moved the dogs 202 toward the sliding sleeve 204. As shown, there are four dogs 202 configured to move through the slots 226 in the stationary housing 212. In the run in position, the packer 116 may be moved to a location to be sealed. For example, the packer 116 may be moved into the RCD 113 (as shown, in FIG. 1) or any other suitable location including, but not limited to, in the wellbore 106, the casing 110, and the like.

Figure 4:
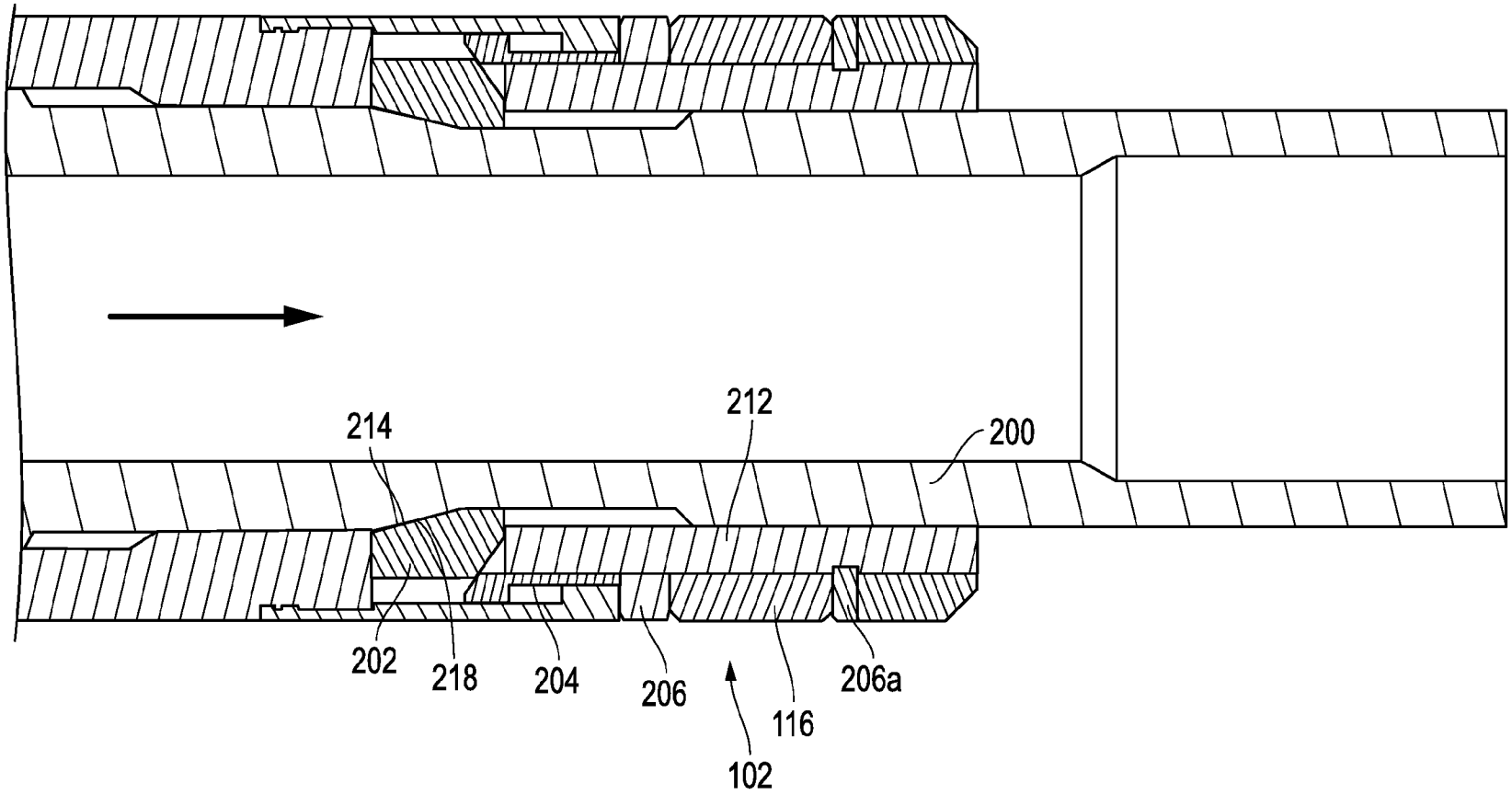
FIG. 4 depicts a longitudinal cross section view or partial setting sequence of the seal system prior to actuation of the seal.

FIG. 4 depicts a longitudinal cross section view of the seal system 102 when the sliding mandrel 200 initially engages the dogs 202 and the packer 116 is still unactuated. As shown, the sliding mandrel 200 has been moved relative to the stationary housing 212 until the setting surface 214 engages the dog setting surface 218.

Figure 5:
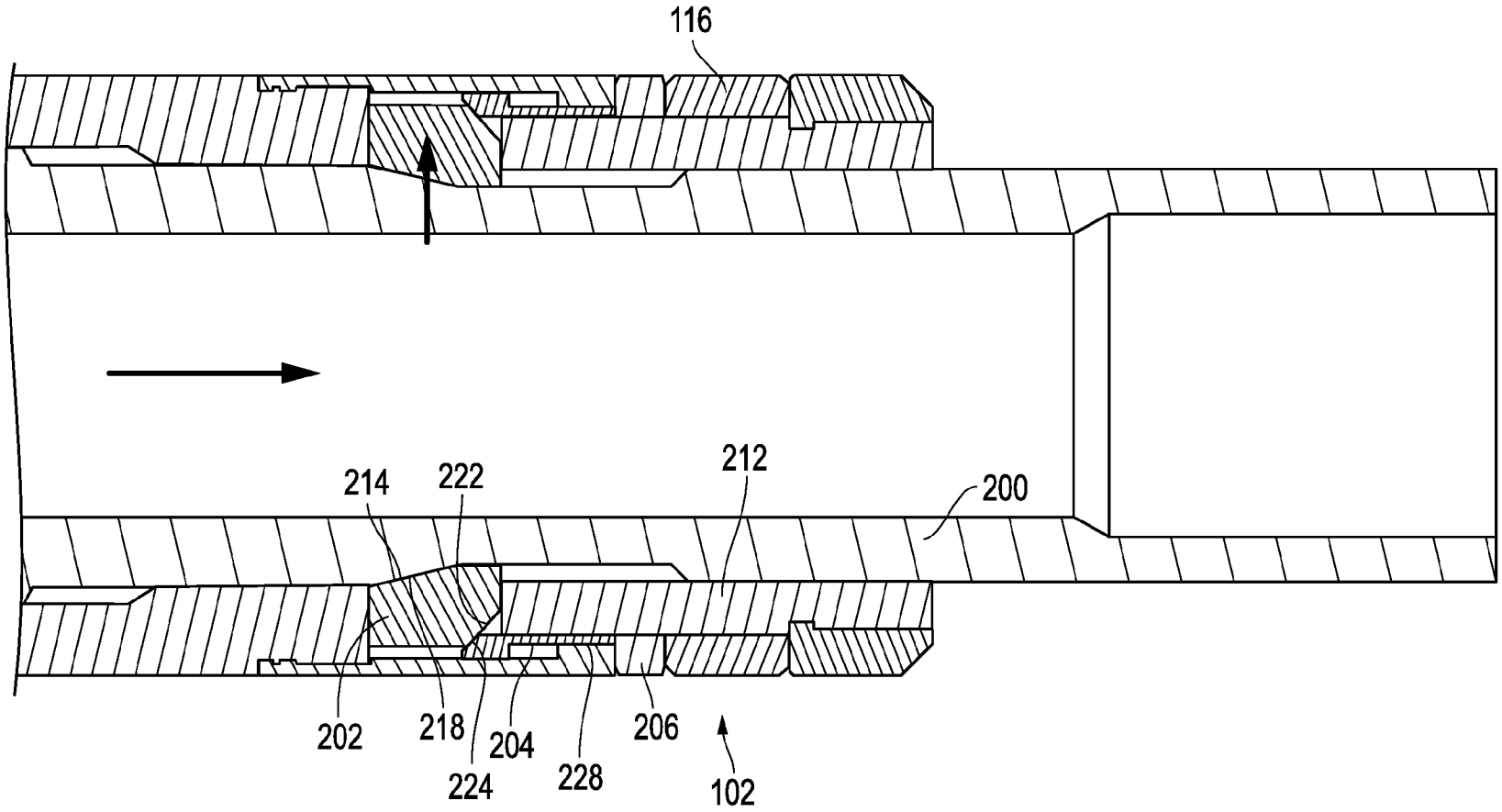
FIG. 5 depicts a longitudinal cross section of the seal system in an intermediate position between the unactuated and actuated position or during the setting sequence.

FIG. 5 depicts a longitudinal cross section of the seal system 102 in an intermediate position between the unactuated and actuated position. In this position, the setting surface 214 has moved the dog(s) 202 radially outward due to continued axial movement of the sliding mandrel 200. The dog actuation surface 222 has engaged the sleeve actuation surface 224 thereby moving the nose 228 of the sliding sleeve 204 into engagement with the packer ring 206. The packer ring 206 may be compressing the packer 116 in this position, but the packer 116 may not be fully actuated.

FIG. 6 depicts a longitudinal cross section of the seal system 102 in an actuated position. The continued movement of the sliding mandrel 200 has moved the dog(s) 202 and thereby the packer 116 into an actuated, or sealed, position. As shown, the setting surface 214 has moved the dog(s) 202 to a position outside of an outer surface 600 of the sliding mandrel 200. The dog actuation surface 222 has moved the sliding sleeve 204 to an actuated position. In the actuated position, the packer ring 206 may have moved longitudinally toward the packer 116 thereby compressing the packer 116. The compression of the packer 116 may extend the packer 116 radially outward into a sealed or actuated position against a casing or subsea riser 300. As shown, the outer sleeve 210 may limit the radial movement of the dog(s) 202. Further, a sliding mandrel shoulder 601 may engage a limit shoulder 602 of the stationary housing 212 in order to limit the movement of the sliding mandrel 200 (e.g. to prevent the sliding mandrel 200 from moving further downhole). Any downhole pressure from below the packer 116 is translated back to the dog(s) 202 and applies a collapse load against the outer surface 600 of the sliding mandrel 200.

Figure 7:
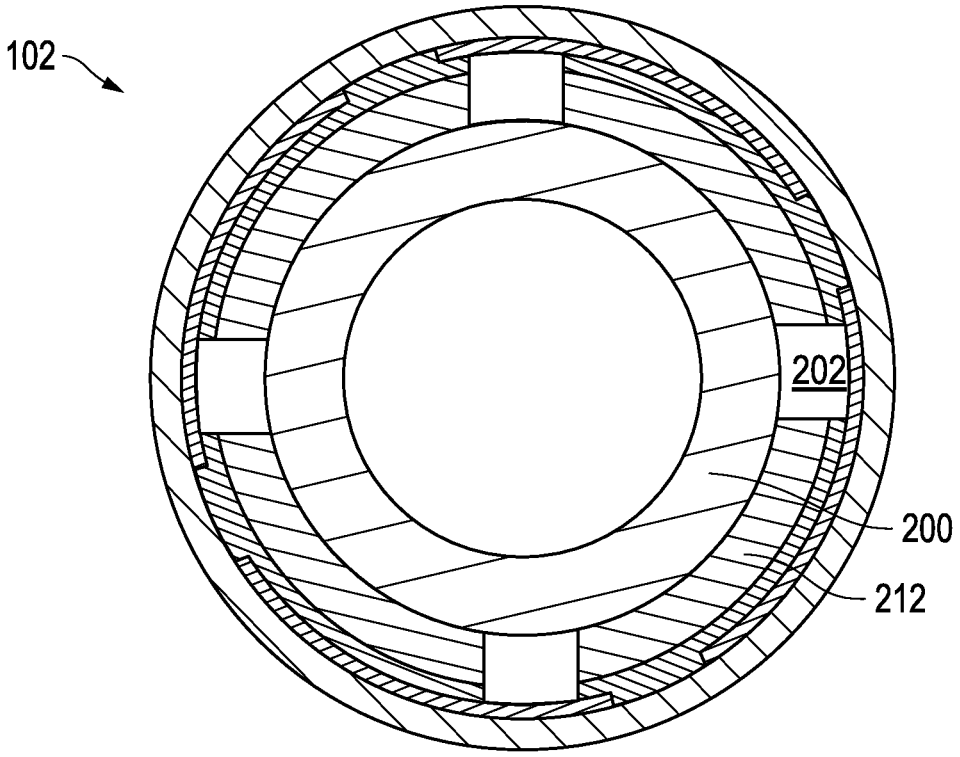
FIG. 7 depicts top cross section view of the seal system in the actuated or set position taken through the dogs.

FIG. 7 depicts top cross section view of the seal system 102 in the actuated position taken through the dogs 202. As shown, the dog(s) 202 are shown radially outside of the sliding mandrel 200.

The seal system 102 may remain in the actuated position until it is desired to remove the seal system 102. To remove the seal system 102, the sliding mandrel may be moved in the opposite axial direction to the actuation direction. When the sliding mandrel 200 reaches a position wherein the setting surface 214 is in longitudinal alignment with the dogs 202, the stored energy in the packer 116 may push the packer ring 206, the sliding sleeve 204 and the dog(s) 202 toward the unactuated position.

Figure 8:
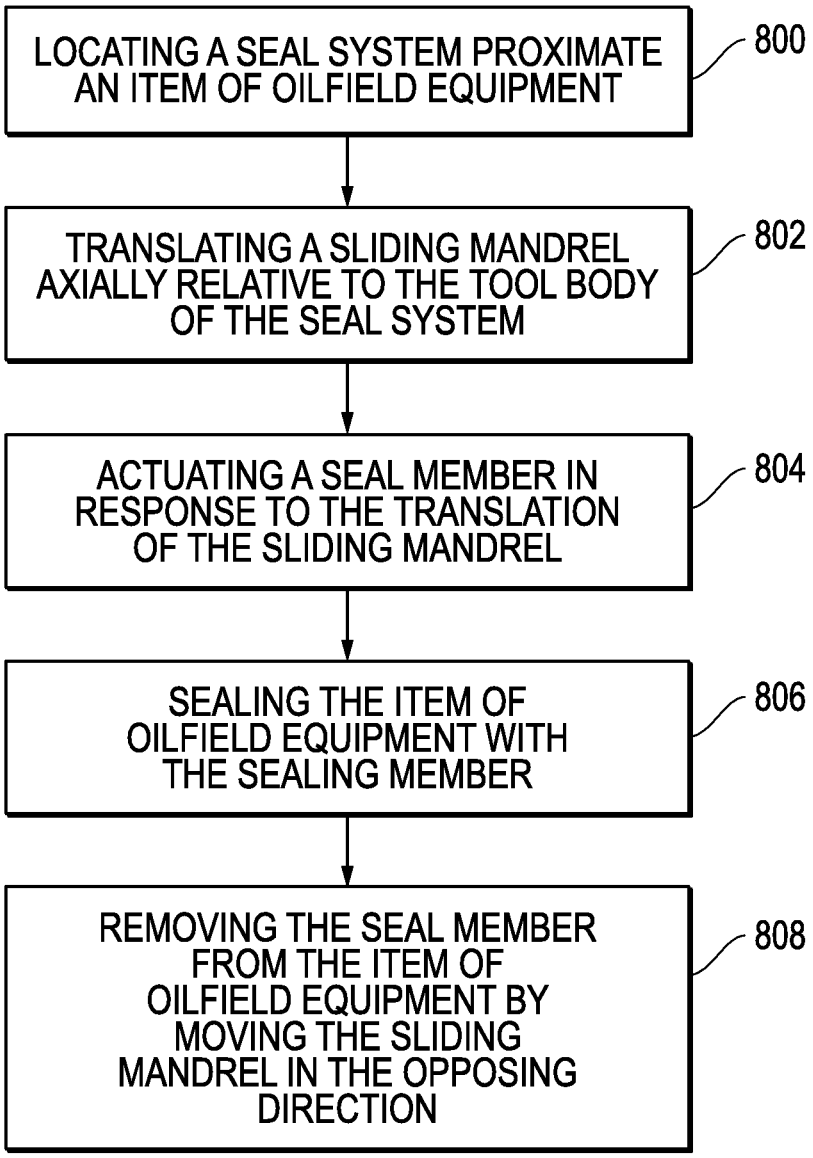
FIG. 8 depicts a method of using the seal system.

FIG. 8 is a flow chart depicting a method of sealing an item of oilfield equipment. The flow starts at block 800 wherein, the seal system is located proximate a piece of oilfield equipment. The flow continues at block 802 wherein, the sliding mandrel 200 is translated axially relative to the tool body of the seal system. The sliding mandrel 200 may be translated using mechanical actuation as discussed above. The flow continues at block 804 wherein, the seal member 116 is actuated in response to the translation of the sliding mandrel 200. The flow continues at block 806 wherein, the item of oilfield equipment 104 is sealed with the seal member 116. The flow continues at block 808 wherein, the seal member 116 is removed from the item of oilfield equipment 104 by moving the sliding mandrel 200 in the opposite direction from the direction it moved during actuation.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to any seal system at the wellsite, such as the downhole packer, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A system for setting at least one sealing member of an item of oilfield equipment, the system comprising:

an inner mandrel;

a sliding sleeve;

a stationary housing positioned radially between the inner mandrel and the sliding sleeve, the stationary housing radially overlying the inner mandrel, and the sliding sleeve radially overlying the stationary housing; and at least one dog, wherein axial displacement of the inner mandrel relative to the stationary housing causes radial displacement of the at least one dog through a slot in the stationary housing, and wherein the radial displacement of the at least one dog causes axial displacement of the sliding sleeve relative to the stationary housing, and sets the at least one sealing member.

2. The system of claim 1, wherein a first surface on the inner mandrel engages a second surface on the at least one dog.

3. The system of claim 2, wherein the first and second surfaces are angled.

4. The system of claim 1, wherein a third surface on the at least one dog engages a fourth surface on the sliding sleeve.

5. The system of claim 4, wherein the third and fourth surfaces are angled.

6. The system of claim 4, wherein the third and fourth surfaces are locked together.

7. The system of claim 1, wherein the at least one dog is biased toward the inner mandrel.

8. The system of claim 1, wherein the axial displacement of the sliding sleeve causes axial compression of the at least one sealing member.

9. The system of claim 8, wherein the at least one sealing member is configured to expand radially outward in response to the axial compression.

10. The system of claim 1, further comprising a packer ring positioned between the at least one sealing member and the sliding sleeve.

11. The system of claim 1, wherein the item of oilfield equipment is a rotating control device.

12. A method of setting and unsetting at least one sealing member at a well site, the method comprising:

positioning a stationary housing radially between an inner mandrel and a sliding sleeve, the stationary housing radially overlying the inner mandrel, and the sliding sleeve radially overlying the stationary housing;

axially displacing the inner mandrel relative to the stationary housing in a first direction, thereby radially displacing at least one dog through a slot in the stationary housing;

axially displacing the sliding sleeve relative to the stationary housing in response to the radially displacing the at least one dog;

axially compressing the at least one sealing member in response to the axially displacing the sliding sleeve; and radially expanding the at least one sealing member in response to the axially compressing, thereby setting the at least one sealing member.

13. The method of claim 12, further comprising:

axially displacing the inner mandrel relative to the stationary housing in a second direction opposite the first direction, thereby unsetting the at least one sealing member.

* * * * *